US006392170B1

(12) United States Patent
Wechsler

(10) Patent No.: US 6,392,170 B1
(45) Date of Patent: May 21, 2002

(54) MANUALLY MOVABLE SLIDING ACTUATOR FOR TOGGLE SWITCH ACTUATOR INCLUDING POSITION RETENTION STRUCTURE

(76) Inventor: Eric J. Wechsler, 162 Townsend Dr., Freehold, NJ (US) 07728

( * ) Notice: Subject to any disclaimer, the term of this patent is extended or adjusted under 35 U.S.C. 154(b) by 29 days.

(21) Appl. No.: 09/624,836

(22) Filed: Jul. 25, 2000

(51) Int. Cl.[7] ..... H01H 3/20; H01H 9/28
(52) U.S. Cl. ..... 200/43.21; 200/43.16
(58) Field of Search ..... 200/42.01–43.22, 200/50.01–50.4, 318–339; 174/66

(56) References Cited

U.S. PATENT DOCUMENTS 5,738,206 A * 4/1998 Souza ..... 200/43.16
5,998,747 A * 12/1999 Kelso et al. ..... 200/331
6,118,088 A * 9/2000 Thielman ..... 200/43.16

* cited by examiner

*Primary Examiner*—J. R. Scott
(74) *Attorney, Agent, or Firm*—Alfred C. Hill

(57) ABSTRACT

The locking device comprises a first member disposed adjacent a toggle switch wall plate to pass a switch arm therethrough and having a first longitudinal slot of predetermined length along a given side thereof; a second member to pass the switch arm therethrough, to slide within the first member from an "ON" position to an "OFF" position and vice versa in step with the switch arm and having a lever extending out of the first longitudinal slot; and a third member disposed to cover the first and second member and to pass the switch arm therethrough, the third member having a second longitudinal slot along the side thereof adjacent the given side and coextensive with the first longitudinal slot and a detent disposed in the second longitudinal slot to lock the lever and, hence, the switch arm in a selected one of an "ON" position and an "OFF" position.

18 Claims, 4 Drawing Sheets

MANUALLY MOVABLE SLIDING ACTUATOR FOR TOGGLE SWITCH ACTUATOR INCLUDING POSITION RETENTION STRUCTURE

BACKGROUND OF THE INVENTION

The present invention relates to toggle switches and more particularly to a locking device to retain a toggle switch in a "OFF" position or a "ON" position to prevent inadvertent movement of the switch to the opposite position.

Electric lights of most homes are controlled by electrical switches that have a switch arm, finger operated to either an "ON" position or "OFF" position. Electrical heaters, garbage disposals, bathroom fans and electric pumps for deep water wells also use similar electrical switches. In most cases, there are no labels placed on the individual switches whether they are located together or separately, so that it is difficult to know exactly which switch operates which motor, or a particular light. It is desirable that motors for equipment, such as garbage disposals, overhead heat lamps, bathroom fans, deep well water pumps, switched receptacle and the like are not turned "ON" accidentally when their use is not desired, or turned "OFF" when their use is desired.

Also, in some cases, such as for a refrigerator or deep well water pump connected to a switch, the position of the switch is "ON" and it is not desired that the switch be accidentally moved to the "OFF" position. Previously, a strip of adhesive tape was placed over the switch to hold it in the desired position, but this requires that the tape be removed when it is desired to move the switch arm. Also, the tape must be replaced after the operation of the controlled device is completed. The tape does pot provide a positive lock.

As previously mentioned, electrical circuits in residential and commercial buildings are often controlled by toggle switches. These toggle switches comprise an arm which is pivoted normally between an "ON" position (upward) and an "OFF" position (downward). This switch may be located close to the load controlled by the switch, or may be significantly remotely located from such a load.

When an electrician or other worker performing operations on the load, or on the load side of the electric circuit thereof, safety requires that the switch controlling that circuit be in an "OFF" position and maintained in its "OFF" position. Although a circuit breaker for that circuit may be deactivated to provide greater safety, deactivating the circuit breaker would disrupt significantly more load devices than would be necessary, needlessly disrupting use of the other load devices.

Inadvertent activation of the switch to its "ON" position while work is being performed on the load side of the circuit can cause injury to the worker and damage to the circuit and load equipment. Thus, the switch needs to be securely maintained in its "OFF" position while the work is being performed.

There are many different types of devices to lock the electrical switches in a selected one of an "ON" position or an "OFF" position. However, these locking devices are very complicated, inconvenient and are expensive to perform the desired function of such a locking device. For instance, some known locking devices require tools and padlocks to provide the locking feature.

SUMMARY OF THE INVENTION

An object of the present invention is to provide a locking device for a toggle wall switch which is inexpensive and easy to use and which provides a positive lock.

Another object of the present invention is to provide a switch locking device that has a movement which is in step with the movement of the switch arm to prevent the inadvertent introduction or interruption of power to a device controlled by the wall switch.

A further object of the present invention is a simple, small, cost effective device to prevent loss of power on an electrical device because of human error in turning the device "OFF" by accidental actuation of the switch controlling the electrical device.

Still a further object of the present invention is a locking device for a toggle switch which may be used anywhere and once installed you do not need tools to operate the locking device which is self contained.

A feature of the present invention is the provision of a locking device for a toggle wall switch comprising a first member disposed adjacent a switch wall plate to pass a switch arm of a toggle switch therethrough and having a first longitudinal slot of predetermined length along a given side thereof; a second member to pass the switch arm therethrough, to slide within the first member from an "ON" position to an "OFF" position and vice versa in step with the switch arm and having a lever extending out of the first longitudinal slot; and a third member disposed to cover the first and second members and to pass the switch arm therethrough, the third member having a second longitudinal slot along a side thereof adjacent the given side and coextensive with the first longitudinal slot and a detent disposed in the second longitudinal slot to lock the lever and, hence, the switch arm in a selected one of the "ON" position and the "OFF" position.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENT

Figure 1:
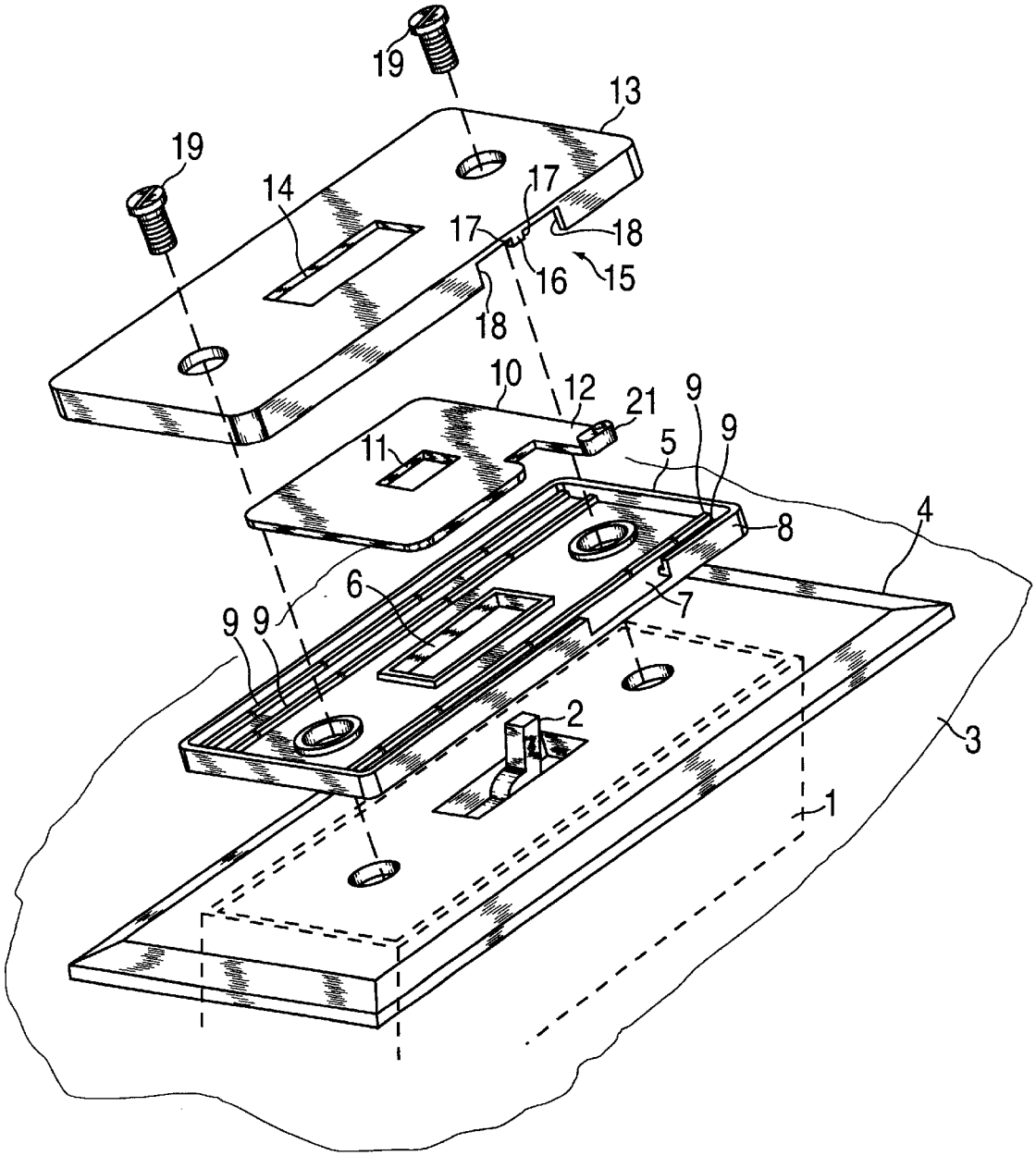
FIG. 1 is an exploded perspective view of the locking device for a toggle wall switch in accordance with the principles of the present invention.
Figure 2:
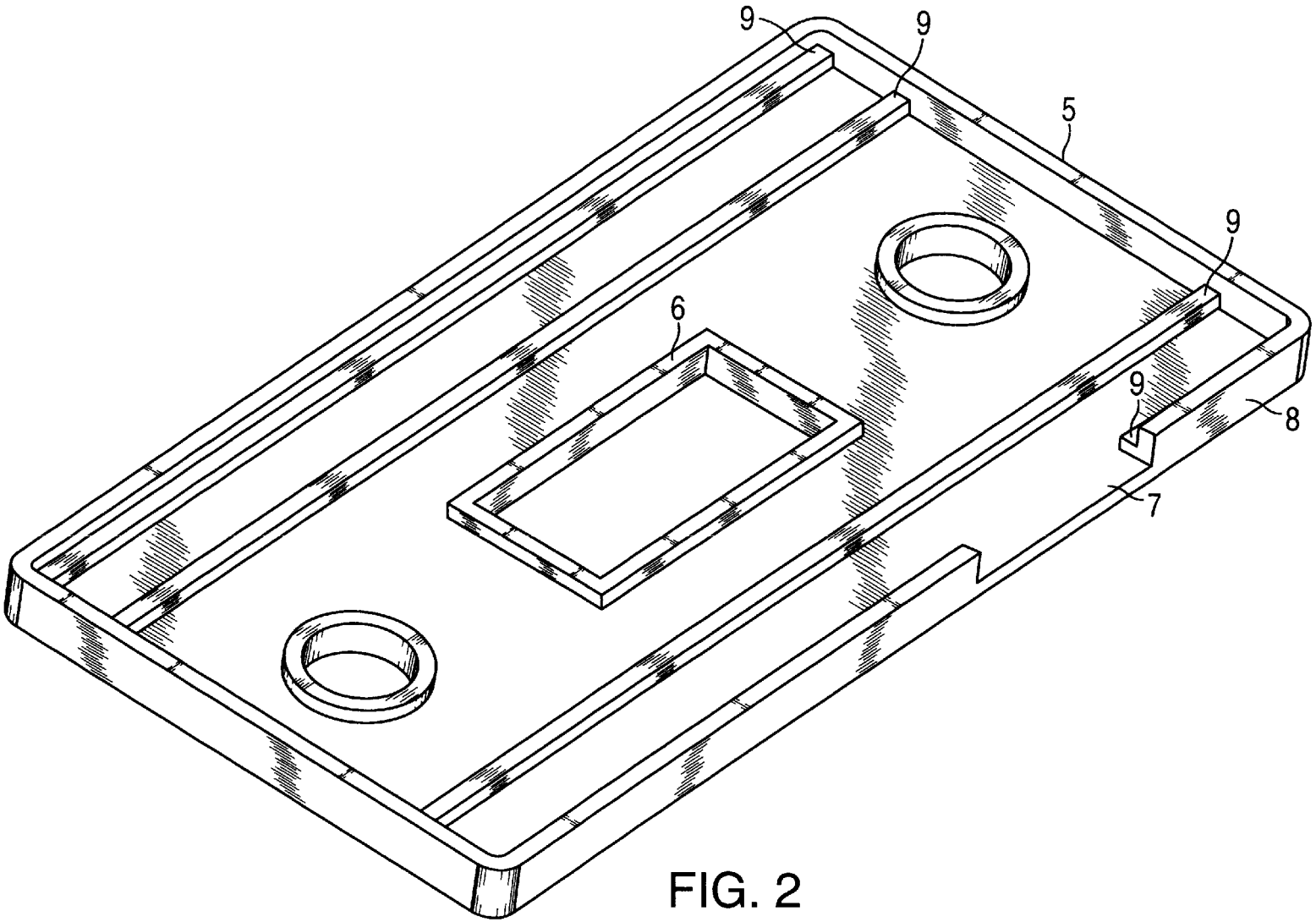
FIG. 2 is a perspective view of the first member of the locking device in accordance with the principles of the present invention.
Figure 3:
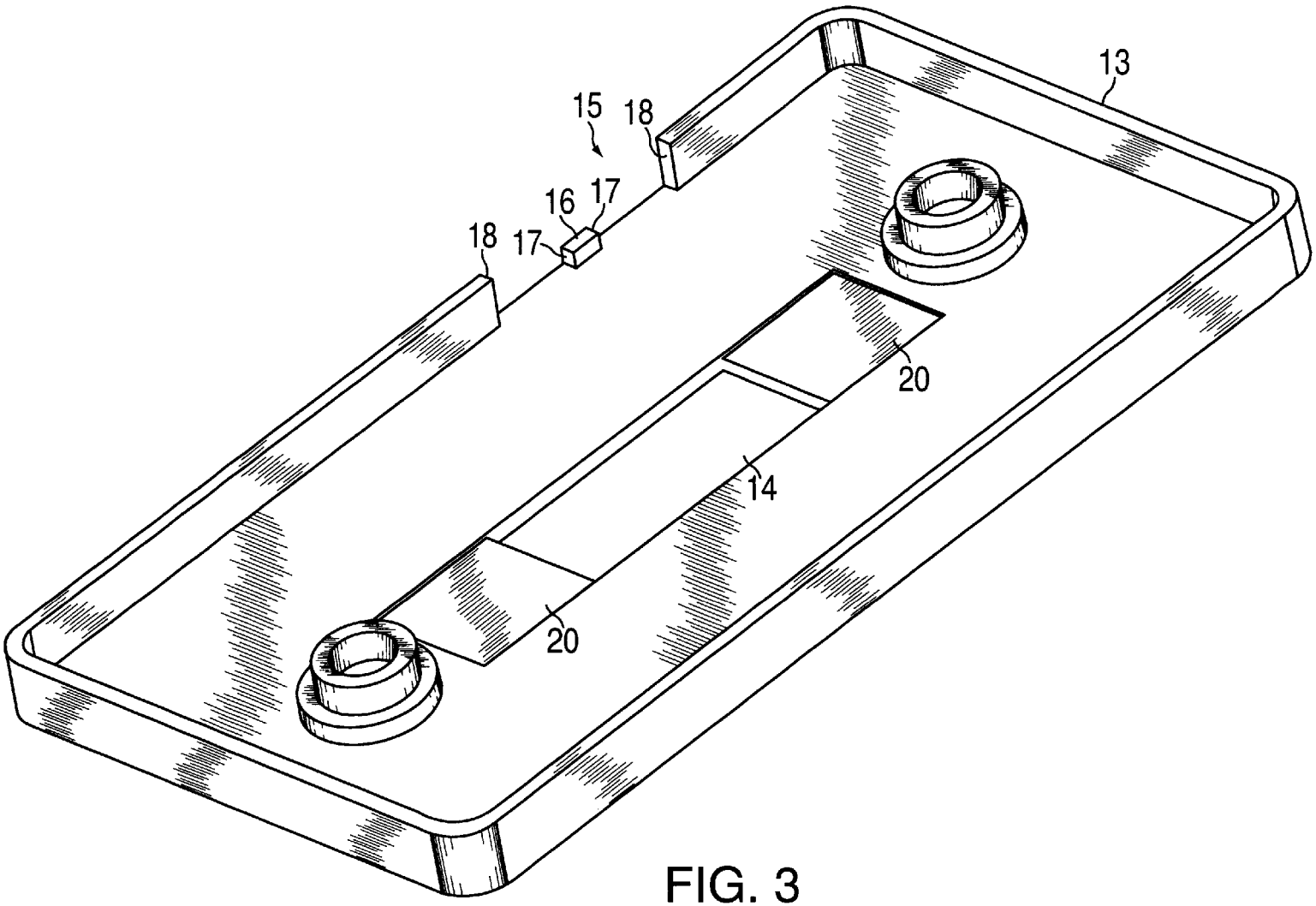
FIG. 3 is a perspective view of the cover or third member of the locking device of FIG. 1 in accordance with the principles of the present invention.

Referring to FIGS. 1–3, the locking device for a toggle wall switch in accordance with the principles of the present invention is illustrated as being associated with a toggle switch contained in an electrical box 1 having a switching arm 2 fastened behind the wall 3 by either securing the box 1 to a structural stud or to the wall 3 itself. The box 1 and toggle switch are illustrated in FIG. 1 to be covered by a wall plate 4.

The locking device in accordance with the principles of the present invention includes a first member 5 disposed adjacent the wall switch plate 4 having a central aperture 6 through which the switch arm 2 passes. Member 5 contains a first longitudinal slot 7 of predetermined length along a given side 8 of member 5. Member 5 is provided with raised track portions 9.

A second member 10 is provided with a central aperture 11 through which switch arm 2 passes and likewise contains a lever 12 that extends out of the longitudinal slot 7. Member 10 is slidable on tracks 9 and is primarily composed of a flexible material. Member 10 can be composed of other material as along as lever 12 is flexible. Member 10, as mentioned, slides within member 5 from an "ON" position to an "OFF" position and vice versa in step with switch arm 2 with the lever 12 being used to cause this movement of member 10.

A third member 13 is disposed to cover member 5 and member 10 and includes a central aperture 14 through which the switch arm 2 passes. Member 13 includes a second longitudinal slot 15 along the side thereof adjacent the given side 8 of member 5 and is coextensive with slot 7. A detent 16 is provided by a member disposed substantially in the center of the slot 15 to project toward the member 5 and has a distance between surfaces 17 and the adjacent edges 18 of slot 15 equal to the width of lever 12 to thereby lock member 10 and, hence, the switch arm 2 in either an "ON" position or an "OFF" position as selected by the switch arm operator.

Screws 19 are employed to fasten the members 5, 10 and 13 as well as wall plate 4 together and to electrical box 1 to form a thin compact unit to lock switch arm 2 in either an "ON" position or an "OFF" position as desired.

Screws 19 are employed to fasten the member 5, 10 and 1 13 as well as wall plate 4 together and to the electrical box 1 to form a thin compact unit to lock the switch arm 12 in either an "ON" position or an "OFF" position as desired.

While FIG. 1 illustrates that the locking device of the present invention is fastened over the usual wall plate 4, it is possible for the locking device to be mounted directly to the box l eliminating wall plate 4. It should be noted that the locking device of the present invention can have any desired color to conform to the desired decorative effect in a room where the locking device is employed.

It should be noted that the words "ON" or "OFF" are silk screened or otherwise imprinted upon member 10 so that there is a positive visual indication of the position of the switch arm 2 so that there is no doubt as to the electrical condition of the device controlled by the toggle switch of switch arm 2. To prevent wearing off of the "ON" and "OFF" indication on the member 10, the portion 20 of member 13 surrounding aperture 14 is indented so as to not rub off the silk screen or otherwise imprinted labels on member 10 as best shown in FIG. 3. The apertures receiving the screws 19 limit the amount of movement of the slide member 10 in addition to the slot 15.

It should further be noted that, the apertures 6 and 14 of members 5 and 13, respectively, through which switch arm 2 passes accommodates the full motion of switch arm 2 while the aperture 11 of member 10 has a shorter corresponding dimension so as to aid in providing the locking of switch arm 2 in a selected one of an "OFF" position or an "ON" position.

Figure 5:
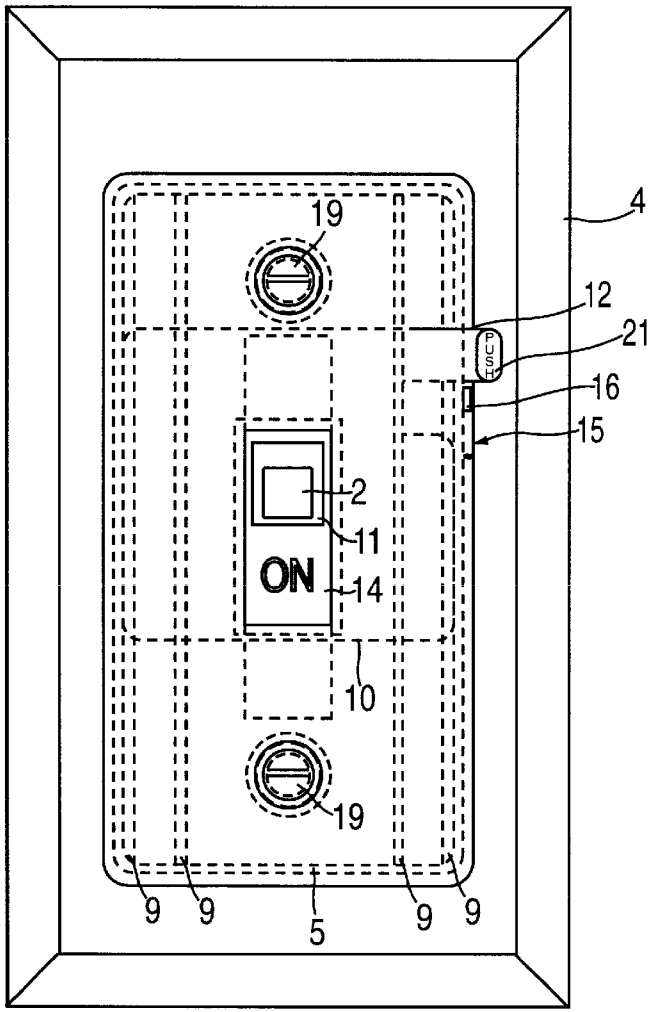
FIG. 5 is a plan view illustrating the operation of the locking device of FIG. 1 where the toggle switch is locked in the "ON" position.
Figure 4:
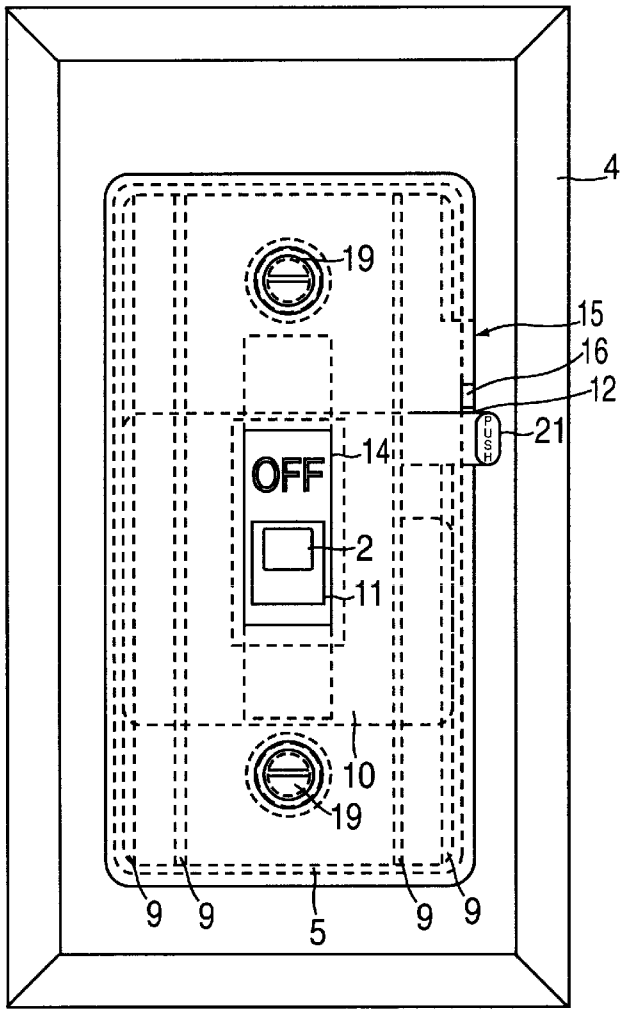
FIG. 4 is a plan view illustrating the operation of the locking device of FIG. 1 where the toggle switch is locked in the "OFF" position.

Referring to FIGS. 4 and 5, there is illustrated therein the locking of the switch arm 2 in a selected one of an "ON" position or an "OFF" position. Referring more specifically to FIG. 4, the movement of member 10 by arm 12 in the position shown locks the switch arm 2 in an "OFF" position and is prevented from being accidentally moved into the "ON" position by the detent 16 in slot 15 of member 13. By pressing flexible arm 12 by the button 21 detent 16 can be bypassed and movement of member 10 can follow the movement of the switch arm 2 to an "ON" position with the switch arm.2 being locked in the "ON" position as shown in FIG. 5. The flexible arm 12 can be moved to by pass the detent 16 because of the raised condition of the tracks 9 in member 5 permits the bypassing of the arm 12 past the detent 16.

While I have described above the principles of my invention in connection with specific apparatus, it is to be clearly understood that this description is made only by way of example and not as a limitation to the scope of my invention as set forth in the objects thereof and in the accompanying claims.

I claim:

1. A locking device for a toggle wall switch comprising:

a first member disposed adjacent a switch wall plate to pass a switch arm of a toggle switch therethrough and having a first longitudinal slot of predetermined length along a given side thereof;

a second member to pass said switch arm therethrough, to slide within said first member from an "ON" position to an "OFF" position and vice versa in step with said switch arm and having a lever extending out of said first longitudinal slot; and a third member disposed to cover said first and second members and to pass said switch arm therethrough, said third member having a second longitudinal slot along a side thereof adjacent said given side and coextensive with said first longitudinal slot and a detent disposed in said second longitudinal slot to lock said lever and, hence, said switch arm in a selected one of said "ON" position and said "OFF" position.

2. A locking device according to claim 1, wherein at least said lever is flexible to enable moving said lever past said detent to select one of said "ON" position and said "OFF" position.

3. A locking device according to claim 2, wherein said first member includes therein raised track portions disposed along the length thereof upon which said second member slides and to enable flexing said lever to bypass said detent.

4. A locking device according to claim 3, wherein said detent includes a fourth member disposed substantially in the center of said second longitudinal slot projecting toward said first member.

5. A locking device according to claim 4, wherein a distance between each surface of said fourth member and adjacent ends of said second longitudinal slot substantially equals the width of said lever to lock said lever in said selected one of said "ON" position and said "OFF" position.

6. A locking device according to claim 1, wherein said first member includes therein raised track portions disposed along the length thereof upon which said second member slides and to enable flexing said lever to bypass said detent.

7. A locking device according claim 6, wherein said detent includes a fourth member disposed substantially in the center of said second longitudinal slot projecting toward said first member.

8. A locking device according to claim 7, wherein a distance between each surface of said fourth member and adjacent ends of said second longitudinal slot substantially equals the width of said lever to lock said lever in said selected one of said "ON" position and said "OFF" position.

9. A locking device according to claim 1, wherein said detent includes a fourth member disposed substantially in the center of said second longitudinal slot projecting toward said first member.

10. A locking device according to claim 9, wherein a distance between each surface of said fourth member and adjacent ends of said second longitudinal slot substantially equals the width of said lever to lock said lever in said selected one of said "ON" position and said "OFF" position.

11. A locking device according to claim 1, wherein a distance between said detent and adjacent ends of said second longitudinal slot substantially equals the width of said lever to lock said lever in said selected one of said "ON" position and said "OFF" position.

12. A locking device according to claim 3, wherein each of said first and third members have a first central aperture through which said switch arm passes having a predetermined length to accommodate full movement of said switch arm from said "ON" position to said "OFF" position and vice versa, and said second member includes a second central aperture through which said switch arm passes have a length less then said predetermined length to assist in locking said switch arm in said selected one of said "ON" position and said "OFF" position.

13. A locking device according to claim 12, wherein at least said lever is flexible to enable moving said lever past said detent to select one of said "ON" position and said "OFF" position.

14. A locking device according to claim 13, wherein said detent includes a fourth means disposed substantially in the center of said second longitudinal slot projecting toward said first member.

15. A locking device according to claim 14, wherein a distance between each surface of said fourth member and adjacent ends of said second longitudinal slot substantially equals the width of said lever to lock said lever in said selected one of said "ON" position and said "OFF" position.

16. A locking device according to claim 12, wherein said first member includes therein raised track portions disposed along the length thereof upon which said second member slides and to enable flexing said lever to bypass said detent.

17. A locking device according to claim 12, wherein said detent includes a fourth member disposed substantially in the center of said second longitudinal slot projecting toward said first member.

18. A locking device according to claim 12, wherein a distance between said detent and adjacent ends of said second longitudinal slot substantially equals the width of said lever to lock said lever in said selected one of said "ON" position and said "OFF" position.

* * * * *